US006868622B2

(12) United States Patent
Dillender

(10) Patent No.: US 6,868,622 B2
(45) Date of Patent: Mar. 22, 2005

(54) HEAT GENERATING CONVEYOR AND TUNNEL OVEN

(76) Inventor: James Stephen Dillender, 4258 S. Broadway, St. Louis, MO (US) 63111

( * ) Notice: Subject to any disclaimer, the term of this patent is extended or adjusted under 35 U.S.C. 154(b) by 0 days.

(21) Appl. No.: 10/267,375

(22) Filed: Oct. 8, 2002

(65) Prior Publication Data

US 2003/0066204 A1 Apr. 10, 2003

Related U.S. Application Data

(60) Provisional application No. 60/327,973, filed on Oct. 9, 2001.

(51) Int. Cl.[7] ..... F26B 19/00
(52) U.S. Cl. ..... 34/236; 34/182
(58) Field of Search ..... 34/181, 182, 183, 34/236, 218

(56) References Cited

U.S. PATENT DOCUMENTS 3,744,145 A * 7/1973 Maxwell et al. ..... 34/68
3,813,214 A * 5/1974 McAlpine ..... 432/144
3,935,647 A * 2/1976 Aschberger ..... 34/105
4,699,119 A * 10/1987 Benko et al. ..... 126/20
4,872,949 A * 10/1989 Wilwerding ..... 159/47.3

* cited by examiner

*Primary Examiner*—Ira S. Lazarus
*Assistant Examiner*—Kathryn S. O'Malley
(74) *Attorney, Agent, or Firm*—Paul M. Denk

(57) ABSTRACT

This invention provides a conveyor and tunnel oven, where the conveyor is continuous, the tunnel oven is gas fired, having its ignited and heated gases passed through a tubular system, being attracted by one or more blowers, to generate by conduction infrared energy to furnish curing to products passing along the continuous conveyor. A control system is provided for controlling the operating parameters such as conveyor speed, regulating emitted gas, the velocity generated by the blowers, and the capacity of the BTUs created, during operations of the oven.

2 Claims, 6 Drawing Sheets

HEAT GENERATING CONVEYOR AND TUNNEL OVEN

CROSS REFERENCE TO RELATED APPLICATIONS

This application claims priority to provisional patent application Ser. No. 60/327,973, filed Oct. 9, 2001.

BACKGROUND OF THE INVENTION

This invention relates generally to an energy efficient gas generating conveyor tunnel oven for use for heating and curing a variety of items moving along a continuous conveyor.

The curing of many types of ink, coatings, and other items, is generally done by the conventional tunnel type oven. These tunnel ovens provide a heated airflow that flows over the items. Many of the items that are cured, such as inks and coatings, however, are made up of one hundred percent solids. There are no solvents or moisture that must be evaporated during the heating or curing process. Thus, curing ovens that are used just for that purpose to cure a particular item, such as a polymer, inks, coatings, or the like, frequently require a different type of heat energy, such as infrared energy or radiant heat, for accomplishing this type of task, without any air flow, or the like.

Tunnel ovens have been available upon the market for industrial, commercial, and other usage, for some time. Continuous conveyors, likewise, are known. Heating systems used in conjunction with such a conveyor, however, have not been significantly improved upon. Most of the heaters previously known to the art generate heated air that flows onto the conveyed items to provide for heating, shrink-wrapping, or the like.

SUMMARY OF THE INVENTION

This invention relates to the creation and application of infrared energy within an enclosed insulated tunnel and in close proximity to a conveyor belt, such as a continuous conveyor, carrying a product to be cured by the energy.

The design of this application utilizes steel or other type of structure to provide for a supporting base. The supporting base holds a belt, to provide for a continuous conveyor, wherein the upper run of the conveyor passes under a heater, while the lower run provides for a return of the belt, during its continuing operations.

The design of this invention utilizes a particularly styled heater or oven, which provides for the generation of heat, through gas, that passes through a series of aligned tubes, or which are pulled therethrough by means of a blower, such as a squirrel cage type of blower, that attracts the gas fired heat, through the arranged tubing, which, by conduction, functioning as a heat exchanger, radiates a heat from the tubing, in the form of infrared energy, in a direction downwardly towards the conveyor belt, and the items being cured thereon. The significant heat passing through the tubing radiates externally thereof, as infrared energy into the ambient environment, at a temperature, which can provide for the type of heating and curing necessary depending upon the products being treated.

The generated flame is enclosed within the tubing, which separates it from direct contact with the product to be cured. Both the quantity of gas, the temperature generated, and the movement of the heated gas, can be precisely controlled by control means, either manually, or through the use of thermocouples and digital temperature controllers, as understood in the art.

The tunnel oven of this invention also includes a structured framework, having a bulkhead or front supporting wall which mounts the various components, controls, burners, gas injectors, igniters, and blowers, that provide the functionality in the heating system. Tubular conduits, such as formed of steel, or other materials, communicate with the gas burners, while the tubing incorporates a circuitous path, generally providing a U-turn at its distal end, while at the opposite end is located a blower, which attracts the heated gases through the tubing, generally along the length of the oven, to generate the controlled heating necessary, in the manner as previously described. Then, the return heat can be exhausted from the building in which the oven locates, or it may pass through an exhaust tube, that may run down the center, or otherwise, of the oven, to generate additional heat, before the spent gases are exhausted externally to the atmosphere, or elsewhere.

One or more of the sets of the heat conveyors, such as the tubing, may be provided in the structure of the oven, depending upon the size and capacity of the heater required. Also, the size of the conveyor will dictate the relative proportions of the heater, to be used in conjunction with this invention.

Various insulated side walls, top walls, and the like, may mount upon the substructure for the oven, in order to preserve the generated heat within the environs of the moving conveyor, thereunder, and to provide safety to the surrounding workers, during usage of this device.

It is, therefore, the principal object of this invention to provide infrared heat for use in conjunction with a continuous conveyor, in the further processing of finishing products.

Still another object of this invention to provide for a unique tubing system for use for generating, by conduction or convection, the type of infrared heat needed to furnish curing to any polymer, inks, or any other products passing through movement of a continuous conveyor.

Still another object of this invention to provide for a compact oven, of the tunnel type, that uniquely generates gas fired heat, through a circuitous system of tubing, to generate the type of heat required for curing or otherwise drying of heat-treated products.

These and other objects may be come more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
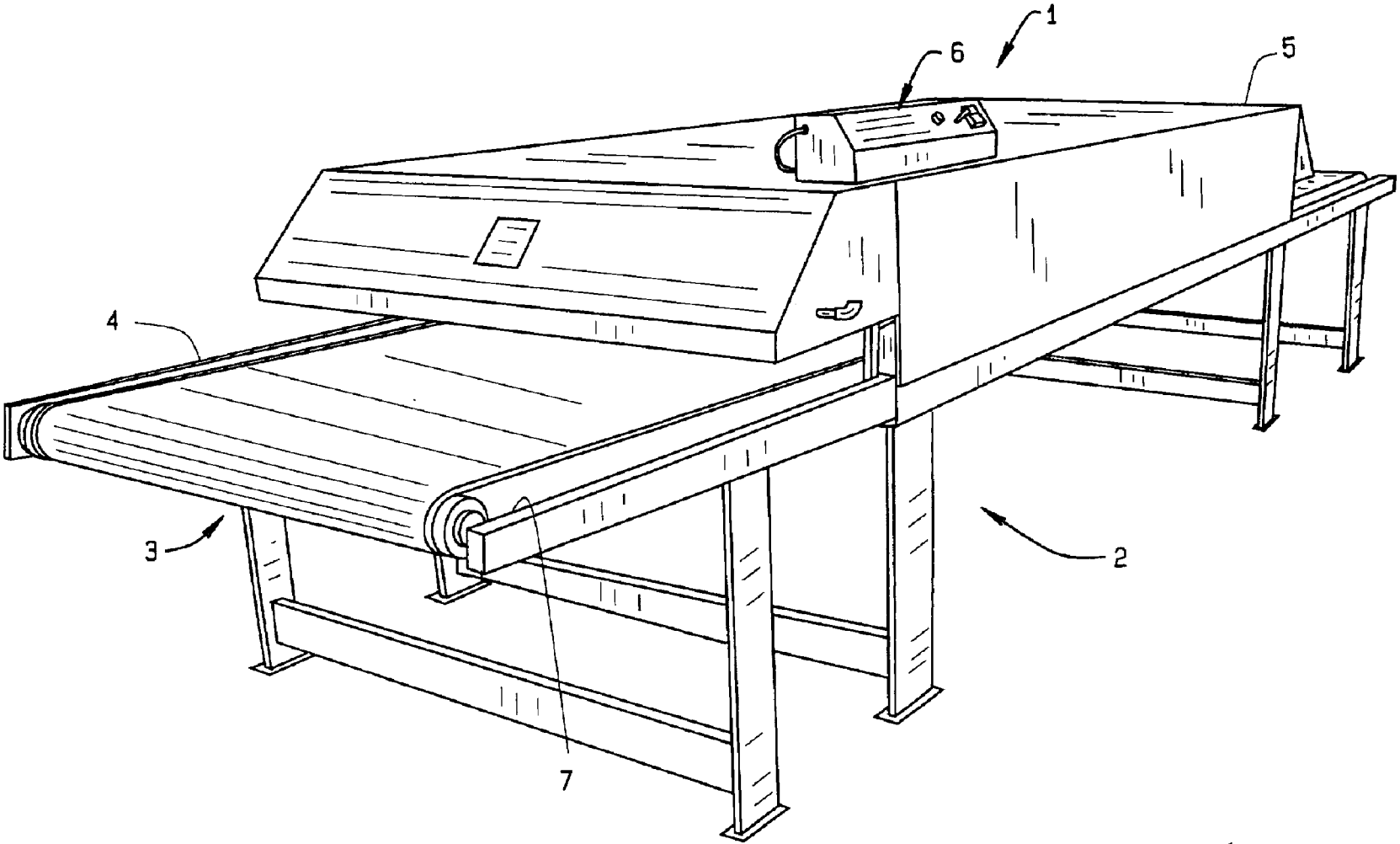
FIG. 1 provides a perspective view of the conveyor and tunnel oven of this invention.

In referring to the drawings, and in particular FIG. 1, therein is shown the conveyor and tunnel oven assembly 1 of this invention. It includes its table assembly 2 and which functions as a support frame and incorporates, along its upper surface, a continuous conveyor 3, which includes, as normally used in a heat environment, a conveyor belt normally fabricated from, in this particular embodiment, a Teflon coated fiberglass belt, as at 4. It is upon this belt that the various items to be heated, cured, or otherwise subjected to significant heat, will pass, continuously, during the processing of such materials, during usage of this particular heater. The continuous conveyor includes a drive mechanism for effecting continuous movement of the conveyor belt 4 as known in the art. The operation of the drive mechanism can be controlled by external controls, as will be explained.

Above the table is included an insulated a hood 5 which contains internally, the various heating elements that are used to provide a radiant heat, normally in the infrared range, that is generated from the heat conveying elements contained within this device, as will be subsequently described. A control box, with panel 6, is provided upon the upper surface of the hood, for use for providing direct access by the operator to the various controls for manipulating the amount of heat generated, the quantity of gas being fed into the heating elements, and, in addition, the conveyor belt speed. Both the quantity of gas, the temperature generated, and the movement of the heated gas, can be precisely controlled by control means, either manually, or through the use of thermocouples and digital temperature controllers, as understood in the art. The functions controlled generally through the control box can be referred to as the operating parameters of the system.

Figure 2:
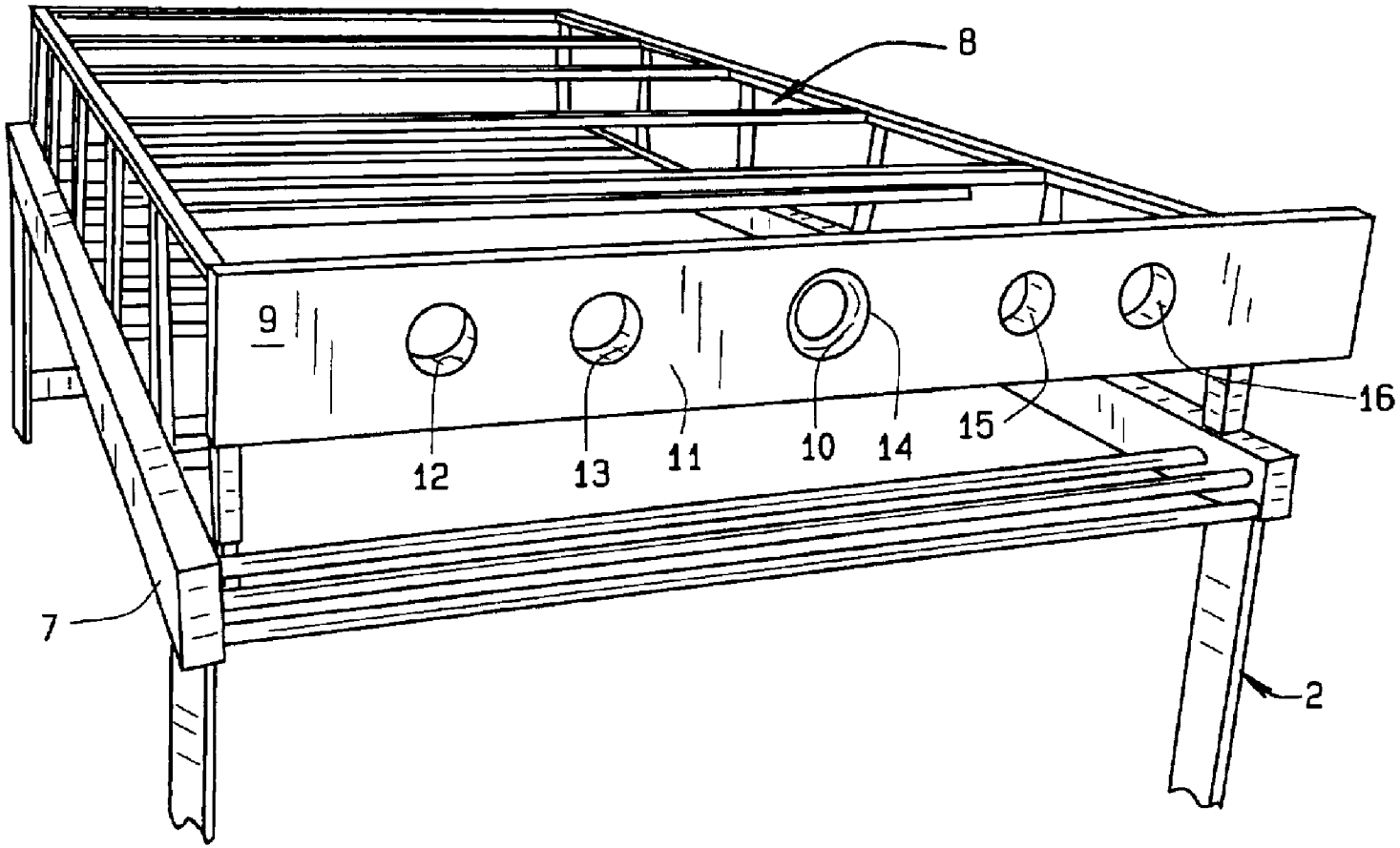
FIG. 2 discloses the supporting structure, for both the conveyor, and the oven, during assembly.

As can be seen in FIG. 2, the structure of the conveyor and tunnel oven of this invention can be more readily seen, during its assembly. The structure for the conveyor belt, forming the table surface, is noted at 7. In addition, the framework or substructure for the hood assembly is noted at 8. It is this subassembly that provides support for the hood structure 5, as previously explained, and in addition, provides for the support through cantilevering or hanging of the gas and fire conveying tubes, normally fabricated of steel, as will be subsequently described. At one end of the substructure 8 is provided a supporting wall 9, and this particular wall is insulated, as can be noted at 10, and provided on either side of the wall steel or sheet metal plates, one is shown at 11, to provide structural support for the operating components of the heater. As can also be noted, there are a series of apertures, as at 12 through 16, in which are designed to hold particular components of the heating elements, and the blower, in addition to the gas injecting means, operatively associated with this invention.

Figure 3:
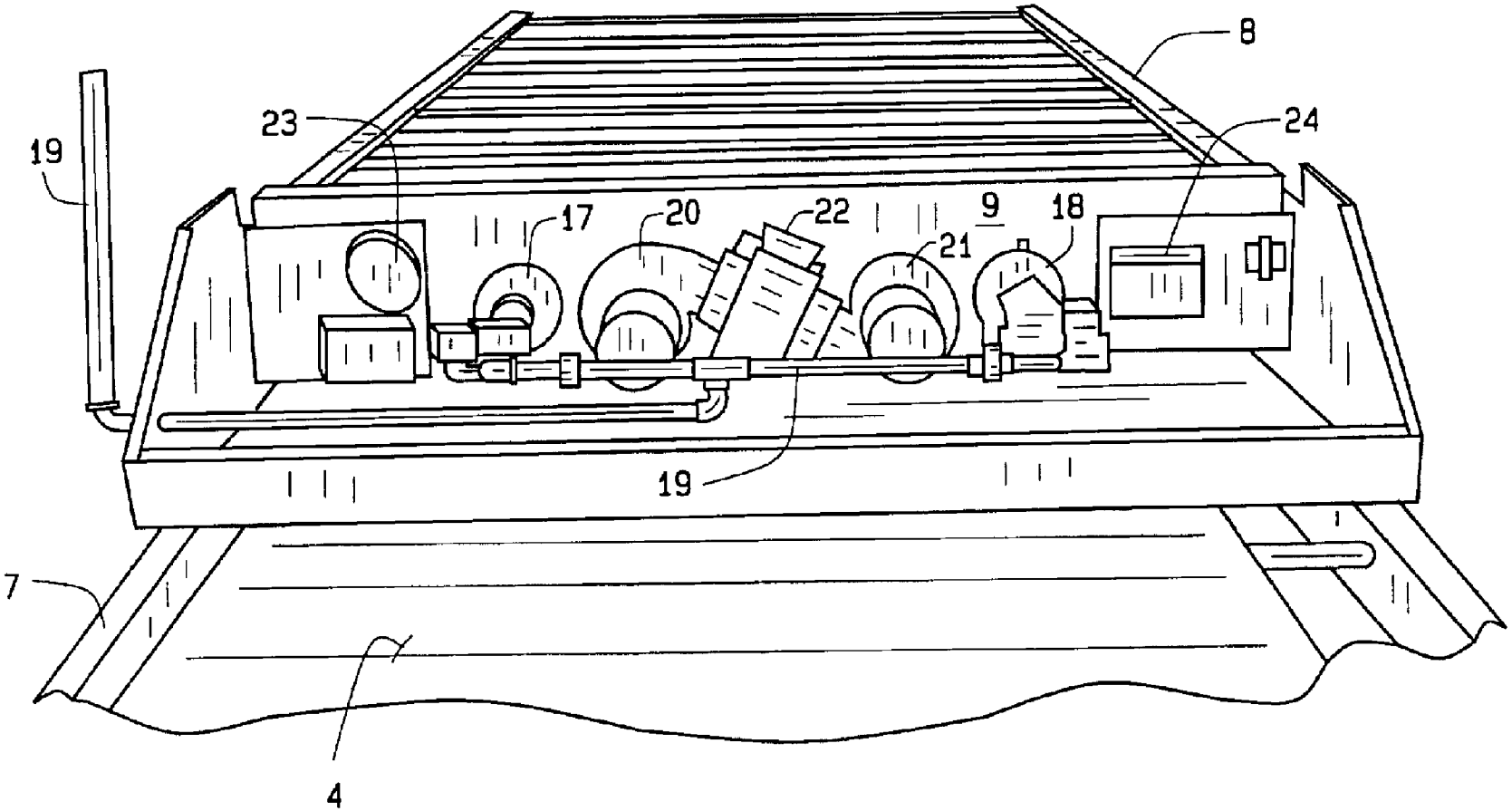
FIG. 3 provides a front view of the supporting wall of the heater of this invention.

As can be seen in FIG. 3, the various operating components for the heater assembly are disclosed. These include the emplacement of the burners 17 and 18, which are mounted directly to the supporting wall 9, and which provide for the injecting of gas, under some pressure, or a standard pressure, delivered to the burners by way of the flow lines 19, as can be noted. The burners normally include the usual type of ignition means, which may comprise the usual type of ignitors that are used in association with burners of this type. The burner assembly, and its ignitors, are of the type that may be obtained from Honeywell Corp., under model No. VR8205A-2024, Honeywell Corp, located in Minneapolis, Minn.

Further mounted to the supporting wall 9 are the pair of blowers 20 and 21, which in this particular instance, are designed to induce a draft, and to actually suck the ignited gas mixture passing into the ductwork, arranged within the heater assembly, as to be subsequently described, and drawing such heated air to an exit, as to be described herein. These draft blowers mount through the apertures 13 and 15, as previously described, for the supporting wall 9. The blowers connect, at their exhaust ends, to a junction chamber 22 and at this location, the air may be passed through duct work that locates through the opening 10, and back into the environs of the tunnel, to supplement the heat therein for heating and curing purposes of any product passing thereunder upon the conveyor. Or, such air can be exhausted either into the room, for heating purposes, or externally of the plant, as may be desired or required. In addition, it is just as likely that the blowers could operate in reverse, and blow air into the duct work, having gas lines and ignitors located shortly downstream from the blowers, to convey heated air through the duct work, in a reverse direction, as can be readily understood by one skilled in the art.

Control panels 23 and 24 contain the various operating controls that are used to facilitate the operations of the heaters and blowers, such as controlling in the amount of spark emitted by the ignitors, the volume of gas injected into the duct work, for temperature control, blower control, in order to coordinate the entire operation, and obtain the precise level of infrared or other heat required to properly treat, bake, or otherwise cure any components traveling along the continuous conveyor, in a manner as previously described.

Figure 4:
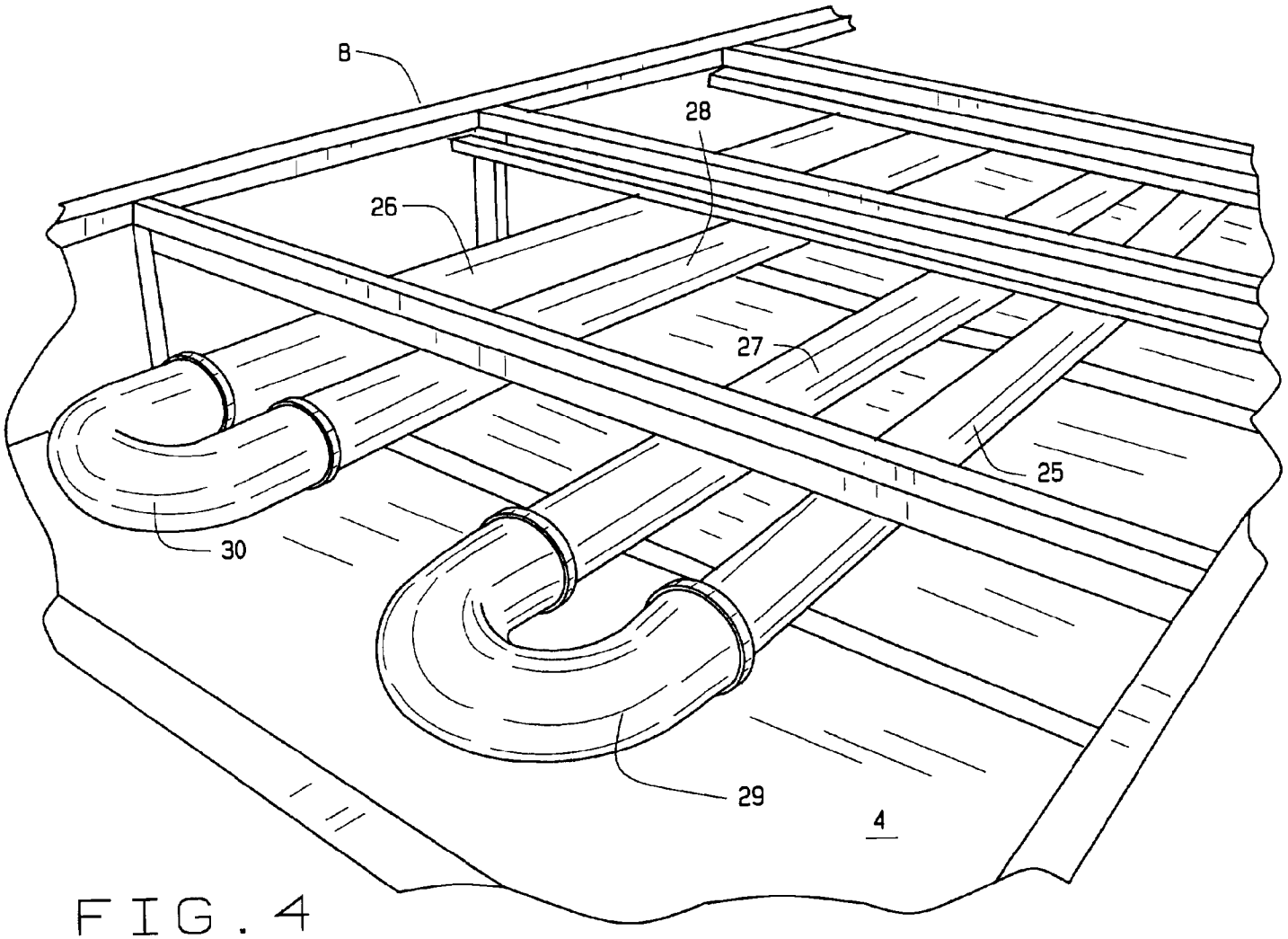
FIG. 4 provides a perspective view of the tubing system providing for conveyance of the generated gas heat, during operations of this system.

The actual ductwork for the heater arrangement can be seen in FIG. 4. In the preferred embodiment, there are two sets of ductwork, generally fabricated with an entrance line, as at 25 and 26, and return lines 27 and 28, respectively. U-joint type of connectors 29 and 30 may be provided at their ends, in order to add to the uniform conveyance of the heated air, through the ductwork, during its operation. The illustrated embodiment shows the ductwork comprising two loops, however, any type of circuitous path could be used for the ductwork, of any configuration, or junctions at their ends, such as the junction box, designed to provide for the continuous flow without obstruction of the heated air through the ductwork, to attain the amount of heating required, for the conveyor system.

These duct works, as can be understood, also connect to the openings 12, 13, 15 and 16, in order to provide for their open communication with the incoming gas lines, and the exhaust or blower fans as previously explained.

Figure 5:
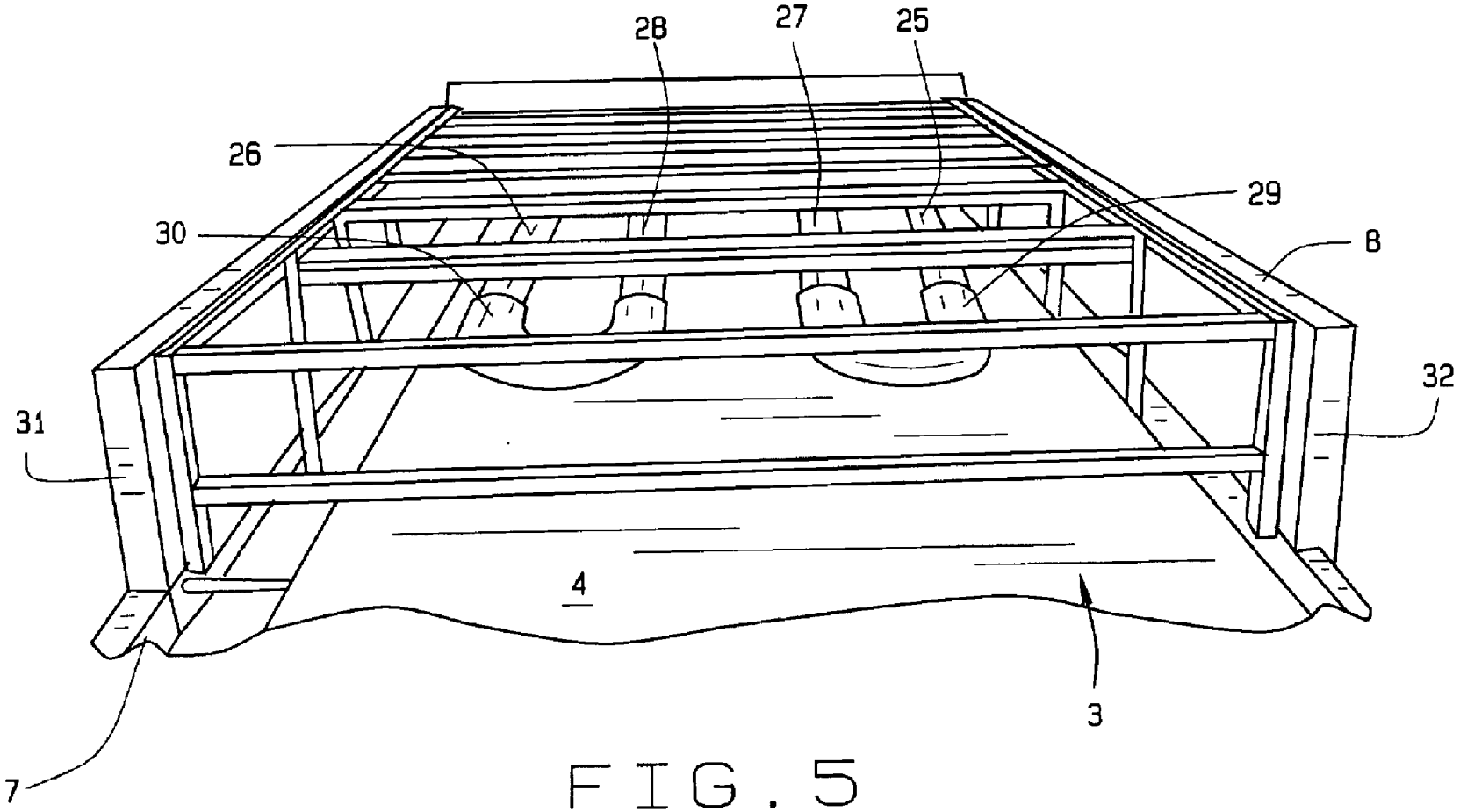
FIG. 5 provides a downstream view of the endless conveyor, and the arrangement of the tubular heating system, with the top covering system of the tunnel oven removed.

As can also be seen in FIG. 5, the formed hood 5 includes side panels 31 and 32, which may be insulated, during this stage of fabrication of the heater conveyor. Obviously, the hood may be fabricated of a unitary structure, formed of stamped metal, preferably insulated therein, in order to form a composite hood, that may be simply brought over the conveyor, once it is assembled, and its heat conveying ductwork installed, therein to provide coverage for the entire assembly, during its fabrication.

Figure 6:
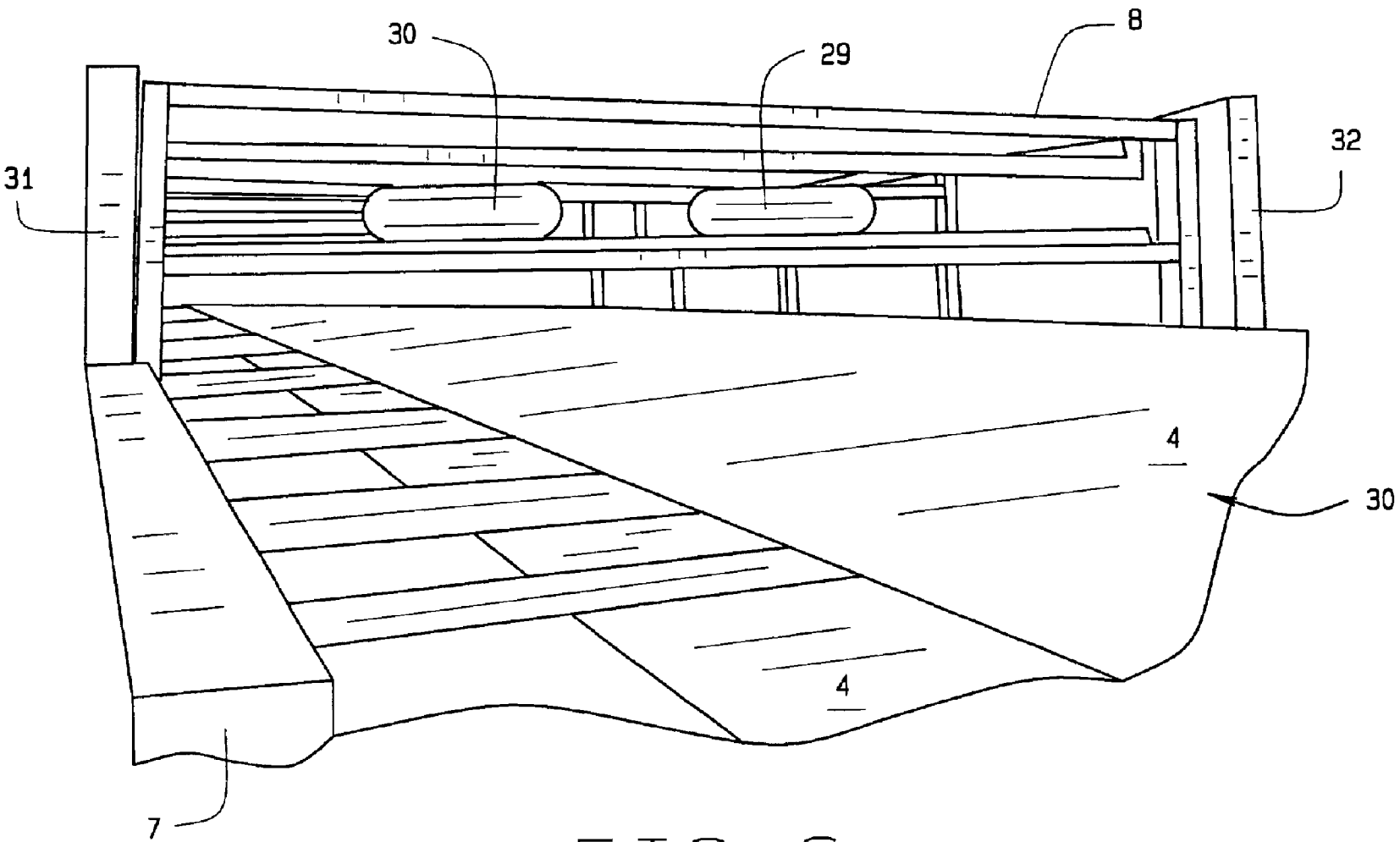
FIG. 6 provides an end view showing the relative location and spacing of the conveyor, and the tubular heating system, of this invention.

FIG. 6 provides an end view of the heater conveyor, with the hood removed, and the ductwork 29 and 30 can be readily noted.

In operation, the heater conveyor, as disclosed in FIG. 1, when set up for operation, will have all of its various operating components readily assembled, in preparation for conveying of material to be treated, passing by way of the continuous conveyor 4. The control panel 6, when operated, provides for initiation of operation of the conveyor. Then, the heater is fired up by the initiation of the firing assembly, which includes the entrance of gas, such as natural gas, under pressure, normally in the range of 5 inches, more or less, of water column, which provides some quantity of gas, under pressure, for discharge and conveyance into the ductwork, as previously explained.

As stated, usually, the gas will enter into the heater assembly through the ducts 25 and 26, as previously reviewed. And, at the same time, the ignitor will provide for the generation of sparking, at the location of the burners 17 and 18, to provide for the spark necessary to ignite the flame, and generate the high quantity of heat, that may be desired, at a certain temperature range, depending upon the amount of heat required for the job specified. For example, in the routine operation of this device, heat may be generated within the ductwork at a range anywhere between a 1,000 to 1,300 or 1,400° F., which radiates heat outside of the steel pipes, forming the ductwork, in the vicinity of approximately 500 to 700° F., during usual operations of this heater conveyor.

The amount of heat generated by the burner assembly is determined by what type of material is being treated, or heated, and temperatures to almost any required degree can be created, through this burner assembly, depending upon the specifications of the work being performed by the conveyor, and giving regard to the type of materials being treated, cured, heated, or the like. Then, as the blowers 20 and 21 attract the heated air through the ductwork, and convey it to the plenum 22, that heated air will be injected back into the vicinity of the conveyor, and at that point of time in the operation of this device, may have a temperature range in the vicinity of 200 to 300° F., as can be expected. Or, as previously explained, this heated air may be exhausted, if not required for other purposes.

During Operations of this device, in the preferred embodiment, the BTU's generated may be within a range of 70,000 to 100,000 BTU's per hour. Obviously, other capacities of generated energy may be created through proper and precise controls of the functioning components of this conveyor and tunnel oven.

As previously explained, the burners for this particular device are obtained from Honeywell Corp., under model No. VR8205A-2024, located at Minneapolis, Minn. The type of blowers used, are the standard squirrel cage type of blowers, and which may be obtained from Emerson Electric Corporation, under model No.4C941-4, manufactured by Emerson, which is located in St. Louis, Mo.

Other instrumentation could be used to achieve the conveyance of heated air, through ductwork relating to that as described herein, to provide for the substantially longitudinal heating of an area above a conveyor belt, required to generate the type of radiant heat needed to cure or otherwise heat elements and materials passing by way of the continuous conveyor 4, during its operation.

Variations or modifications to the subject matter of this invention may occur to those skilled in the art upon reviewing the description of the invention as provided herein. Such variations, if within the spirit of this development, are intended to be encompassed within the scope of the invention as described in this disclosure. The description of the preferred embodiment, as shown in the drawings, is set forth for illustrative purposes only.

I claim:

1. A conveyor and tunnel oven apparatus for curing products by heat, comprising:

a support frame;

a conveyor system supported by said frame, said conveyor system further comprising a continuous conveyor belt designed to accommodate the products to be cured and a drive mechanism for effecting controlled movement of said conveyor belt;

a tunnel oven upwardly adjacent the conveyor system comprising an insulated housing, a tubular heat exchange system within the housing having a first loop and a second loop positioned above the conveyor belt, a first burner for heating gases within the first loop, a second burner for heating gases within the second loop, a first blower for a effecting movement of heated gases within the first loop of the tubular heat exchange system, and a second blower for effecting movement of heated gases within the second loop of the tubular heat exchange system, said tubular heat exchange system, is positioned above said continuous conveyor belt, wherein the gases are heated within the tubular heat exchange system to a temperature to approximately 1000° F. to approximately 1400° F. and the heat exchange system being located at a distance above said continuous conveyor belt to achieve the generation of heated gases provided by radiant heat outside the tubular heat exchange system of approximately 500° F. to approximately 700° F. at the surface of the continuous conveyor belt accommodating any product being cured by heat thereon;

a control system for controlling the operating parameters for the belt speed and generation of heat by the apparatus, whereby heated gases within the tubular heat exchange system provide radiant heat outside the tubular heat exchange system so as to cure any products on the continuous conveyor belt by radiant heat; and wherein the burner is gas fired.

2. The apparatus of claim 1 wherein the conveyor belt is a fiberglass belt.

* * * * *